US009610958B2

(12) United States Patent
Cho et al.

(10) Patent No.: US 9,610,958 B2
(45) Date of Patent: Apr. 4, 2017

(54) FIXED BLOCK TRACK CIRCUIT

(71) Applicant: China Engineering Consultants, Inc., Taipei (TW)

(72) Inventors: Hsun-Jung Cho, Hsinchu (TW); Hsu Ju, Taipei (TW); Kun-Yu Liu, New Taipei (TW); Ming-Hung Chien, Kaohsiung (TW)

(73) Assignee: CHINA ENGINEERING CONSULTANTS, INC., Taipei (TW)

( * ) Notice: Subject to any disclaimer, the term of this patent is extended or adjusted under 35 U.S.C. 154(b) by 104 days.

(21) Appl. No.: 14/750,264

(22) Filed: Jun. 25, 2015

(65) Prior Publication Data

US 2016/0375917 A1 Dec. 29, 2016

(51) Int. Cl.
*B61L 1/18* (2006.01)
*B61L 13/04* (2006.01)
*B61L 23/16* (2006.01)

(52) U.S. Cl.
CPC ..... *B61L 1/185* (2013.01); *B61L 13/042* (2013.01); *B61L 23/163* (2013.01)

(58) Field of Classification Search
CPC ..... B61L 23/34; B61L 13/00; B61L 21/10
See application file for complete search history.

(56) References Cited

U.S. PATENT DOCUMENTS 5,903,517 A * 5/1999 Futsuhara ..... B61L 23/34 367/120
2014/0054424 A1* 2/2014 Xu ..... B61L 23/18 246/122 R
2014/0214248 A1* 7/2014 Yamada ..... B60L 15/40 701/20
2014/0346284 A1* 11/2014 Fries ..... B61L 13/00 246/125
2016/0325765 A1* 11/2016 Haedicke ..... B61L 3/12

* cited by examiner

*Primary Examiner* — Jason C Smith
(74) *Attorney, Agent, or Firm* — Jackson IPG PLLC; Demian K. Jackson

(57) ABSTRACT

An active fixed block track circuit comprises at least a fixed block section, comprising at least two rails corresponding to each other, each having an isolation connector at two ends thereof and connected to a power supply unit and a traffic signal; a short driving unit, connected to each of the two rails within the fixed block section; and a detection unit, connected to the short driving unit. In this manner, not only the previous rail traffic signal circuit function where no more than one train may be allowed into the same fixed block section is maintained, but also another train approaching from the rear may be prevented from entering the fixed block section when the detection unit at the fixed block section detects an exceptional case happening at a neighboring fixed block section so that the traffic signal unit is switched into a stop traffic signal.

5 Claims, 2 Drawing Sheets

FIXED BLOCK TRACK CIRCUIT

FIELD OF THE INVENTION

Figure 1:
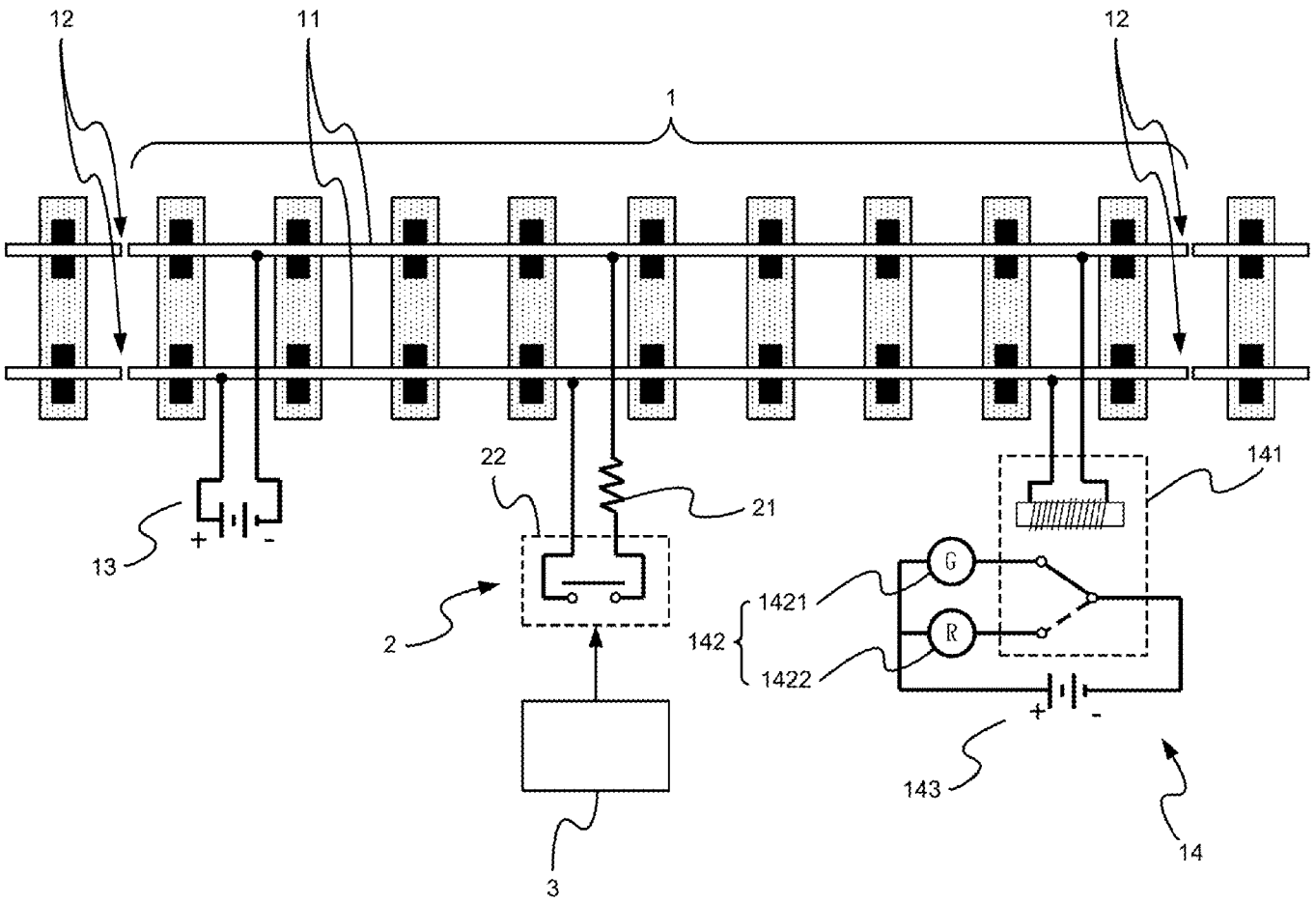

The present invention relates to an active fixed block track circuit and particularly to such device where a train on rails may be provided with a safety protection.

DESCRIPTION OF THE RELATED ART

Conventionally, a railway track circuit is designed by considering that a railway route area comprises several fixed block sections. When a train enters a rail block, an area traffic lamp is switched from a pass traffic signal type to a stop traffic signal type. At this time, when another train rear to the above train approaches will stop at the fixed block section rear to the above rail closure area, so that the two trains may not collide into an accident.

However, when an exceptional case happens at the fixed block section neighboring to the fixed block section, there is no any automatic detection function. At this time, a train driver and a worker are required to monitor this exceptional case and inform to each other by a wireless radio. In this manner, the train driver and the worker may be caused with some work pressure, and may further expose a shortage of a safety protection issue.

TW patent M414580, entitled "a water level detector used for a side slope monitor system" or TW patent M438683, entitled "landslide monitor system", may be used on a railway traffic signal circuit. However, when the two TW patents are applied onto the water level detector disposed at a railway side slope or a road basis along the rails, or applied to where the railway side slope landslide and land and stone avalanche are required to be monitored, another alarm device is required to be provided although the train's safety is increased. This may also increase the train driver and workers' work pressure, and the detection device's setup and maintenance may be increased.

Therefore, the inventor of this application set forth an active fixed block track circuit capable of detecting an exceptional case to effectively improve the shortage of the prior art.

SUMMARY OF THE INVENTION

It is a main object of the present invention to consider that after a train enters a fixed block section, a traffic signal lamp at the fixed block section is switched from a pass traffic signal to a stop traffic signal, so that a rear train stops and waits at a rear fixed block section and thus may not collide with a post train In addition, the detection unit may short the fixed block section through a short driving device, and may also switch a pass traffic signal type to a stop traffic signal type for a traffic signal unit corresponding to the fixed block section, so that the rear train may not enter the fixed block section having the exceptional case.

In this manner, the purposes of a simple structure of the railway system, a reduced setup and maintenance cost, a decreased work pressure for a train driver and workers' monitor task, and an effective safety protection.

To achieve the above object, the active fixed closure sign traffic signal device comprises at least a fixed block section, comprising at least two rails corresponding to each other, each having an isolation connector at two ends thereof and connected to a power supply unit and a traffic signal; a short driving unit, connected to each of the two rails within the fixed block section; and a detection unit, connected to the short driving unit.

In an embodiment, the power supply unit is a direct current (DC) power source.

In an embodiment, the traffic signal unit comprises a relay connected to each of the two rails, a traffic signal lamp connected to the relay, and a traffic signal lamp connected to the power source.

In an embodiment, the traffic signal lamp further comprises a pass lamp type and a stop lamp type.

In an embodiment, the short driving unit comprises a current limited resistor connected to each of the two rails and a short switch element connected to the current limit resistor.

In an embodiment, the detection unit comprises an instrument, an apparatus, a system, or a circuit for detecting an exceptional case.

BRIEF DESCRIPTIONS OF THE DRAWINGS

Figure 2:
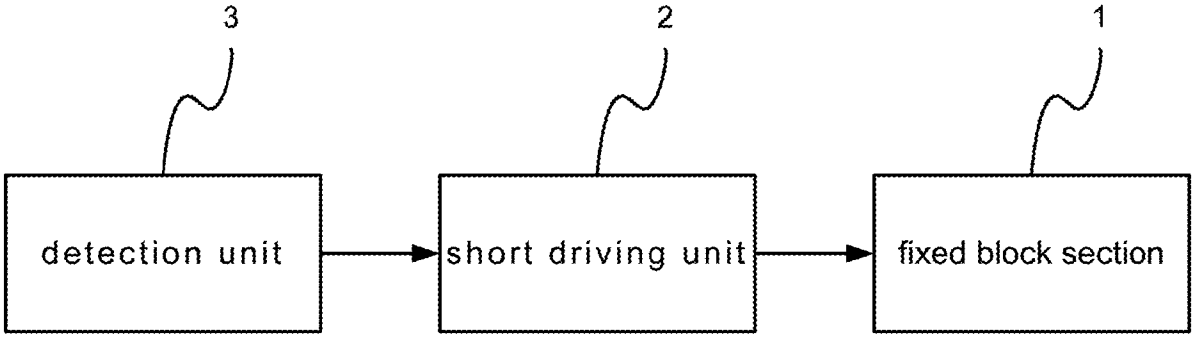

The present invention will be better understood from the following detailed descriptions of the preferred embodiments according to the present invention, taken in conjunction with the accompanying drawings, in which:

FIG. 1 is a schematic diagram of a basic architecture according to the present invention; and FIG. 2 is a schematic block diagram of the present invention.

DESCRIPTION OF THE PREFERRED EMBODIMENTS

Referring to FIG. 1 and FIG. 2, a schematic diagram of a basic architecture according to the present invention, and a schematic block diagram of the present invention. As shown, the present invention is an active fixed block track circuit capable of detecting an exceptional case, which comprises at least a fixed block section 1, a short driving unit 2, and a detection unit 3.

The fixed block section 1 comprises at least two corresponding rails 11, each having an isolation connector 12 disposed at two ends thereof. Further, each of the rails 11 is connected to a power supply unit 13 and a traffic signal unit 14. The power supply unit 13 is a direct current (DC) power source. The traffic signal unit 14 comprises a relay 141 connected to each of the rails 11, a traffic signal lamp 142 connected to the relay 141, and a power source 143 connected to the traffic signal lamp 142. In addition, the traffic signal lamp 142 further comprises a pass traffic signal type 1421 and a stop traffic signal type 1422.

The short driving unit 2 is connected to each of the rails 11 at the fixed block section 1. The short driving unit 2 comprises a current limited resistor 21 connected to each of the rails 11, and a short switch element 22 connected to the current limited resistor 21.

The detection unit 3 is connected to the short switch element 22. The detection unit 3 comprises an instrument, an apparatus, or a circuit. As such, the structure described above forms a novel active fixed block track circuit capable of detecting an exceptional case.

When the present invention is used, not only the previous rail traffic signal circuit function, where the fixed block section 1 is exempted from more than one train staying therein, is maintained, but an exceptional case may be effectively processed. The mentioned exceptional case comprises a side slop avalanche event, a person invade event, a too high water level event, a tunnel collapse event, a bridge breakage and fall-off event, and a roadway run-off event. At this time, a signal is transmitted or stopped with respect to the short driving unit 2, so that the current limited resistor 21 and the short switch element 22 work together to switch into a short state. At this time, after the fixed block section 1 is shorted, the traffic signal lamp unit 14 fails to transit the relay's state, forcing the traffic signal lamp 142 at the fixed block section 1 to switch into a stop traffic signal type 1422, so that an approaching train is forced to stop and wait at the fixed block section. If the detection unit 3 detects that the exceptional case is excluded, the short driving unit 2 is switched into an open state by a coordination of the current limited resistor 21 and the short switch element 22. On the other hand, the fixed block section 1 recovers its original state, enabling the traffic signal lamp unit 14 to receive a power source from the power supply unit 13 to transit the state of the relay 41, so that the train approaching rear may enter the fixed block section 1.

In summary, the active fixed block track circuit capable of detecting an exceptional case may effectively improve shortages encountered in the prior art. After a train enters a fixed block section, the traffic signal lamp at the fixed block section is switched from the pass traffic signal to the stop traffic signal, so that a rear train stops and waits at a rear fixed block section and thus may not collide with a post train. In addition, the detection unit may short the fixed block section through the short driving device, and may also switch the pass traffic signal type to the stop traffic signal type for the traffic signal unit corresponding to the fixed block section, so that the rear train may not enter the fixed block section having the exceptional case. In this manner, the purposes of a simple railway system structure, a reduced setup and maintenance cost, a decreased work pressure for a train driver and workers' monitor task, and an effective safety protection.

From all these views, the present invention may be deemed as being more effective, practical, useful for the consumer's demand, and thus may meet with the requirements for a patent.

The above described is merely examples and preferred embodiments of the present invention, and not exemplified to intend to limit the present invention. Any modifications and changes without departing from the scope of the spirit of the present invention are deemed as within the scope of the present invention. The scope of the present invention is to be interpreted with the scope as defined in the claims.

What is claimed is:

1. An active fixed block track circuit, comprising:

at least a fixed block section, comprising at least two rails corresponding to each other, each having an isolation connector at two ends thereof and connected to a power supply unit and a traffic signal;

a short driving unit, connected to each of the two rails within the fixed block section; and a detection unit, connected to the short driving unit, wherein the short driving unit comprises a current limited resistor connected to each of the two rails and a short switch element connected to the current limit resistor.

2. The active fixed block track circuit as claimed in claim 1, wherein the power supply unit is a direct current (DC) power source.

3. The active fixed block track circuit, wherein the traffic signal unit comprises a relay connected to each of the two rails, a traffic signal lamp connected to the relay, and a traffic signal lamp connected to the power source.

4. The active fixed block track circuit as claimed in claim 3, wherein the traffic signal lamp further comprises a pass lamp type and a stop lamp type.

5. The active fixed block track circuit as claimed in claim 1, wherein the detection unit comprises an instrument, an apparatus, a system, or a circuit for detecting an exceptional case.

* * * * *